US006785125B1

(12) United States Patent
Young

(10) Patent No.: US 6,785,125 B1
(45) Date of Patent: Aug. 31, 2004

(54) FORCE ACTIVATED SWITCH

(75) Inventor: Gerald P. Young, Bel Air, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/216,964

(22) Filed: Aug. 12, 2002

(51) Int. Cl.[7] ..... H01R 9/00

(52) U.S. Cl. ..... 361/679; 361/801; 200/85 RA; 340/665

(58) Field of Search ..... 361/679–687, 361/825, 801–802; 307/118; 200/85 RA, 86 R; 340/573.1, 665–667

(56) References Cited

U.S. PATENT DOCUMENTS 5,451,722 A * 9/1995 Gregoire ..... 174/261
5,780,793 A * 7/1998 Buchholz et al. ..... 200/61.44
5,973,283 A * 10/1999 Ariga et al. ..... 200/512
6,498,503 B2 * 12/2002 Akram et al. ..... 324/754
6,608,270 B2 * 8/2003 Donofrio et al. ..... 200/302.1

* cited by examiner

*Primary Examiner*—Hung Van Duong
(74) *Attorney, Agent, or Firm*—Ulysses John Biffoni

(57) ABSTRACT

An apparatus and method for a switch that is activated by a predetermined mechanical load includes a first layer of plastic material, a second layer of plastic material, a layer of elastomeric material having first and second surfaces, the first surface bonded to the first layer of plastic material by a layer of adhesive material and the second surface of the elastomeric material bonded to the second layer of plastic material by a layer of adhesive; and a conductor disposed in contact with one or more of the layers of material wherein a conductive path of the conductor is broken when at least one of the adhesive bonds is displaced by the predetermined mechanical load.

28 Claims, 2 Drawing Sheets

FORCE ACTIVATED SWITCH

GOVERNMENT INTEREST

The invention disclosure herein may be manufactured, licensed, and used by or for the United States Government.

TECHNICAL FIELD

The present invention is related in general to optical or electrical switches and more particularly to a method and apparatus for optical or electrical switching in response to a predetermined mechanical stress or load.

BACKGROUND INFORMATION

Many devices are activated in response to the application of a mechanical force. For example, some munitions systems are designed to activate (or deactivate) in response to an impact force or a percussion. A typical percussion fuze for a munition includes a mechanical inertial mass that strikes a fulminating compound in response to impact of the munition or a rapid deceleration. In another example, supplemental inflatable restraint systems (e.g., air bags) employ a variety of force sensors to activate the system. Typically, these sensors are mechanical/inertial units with a rotor, an eccentric mass and contacts. If deceleration is sufficient, the mass causes the rotor to turn, pushing the points together and activating the air bag. Some supplemental inflatable restraint systems include decelerometers, i.e., cantilevered tab-type strain gauges that bend under deceleration and close contacts to activate the air bag. In addition, some supplemental inflatable restraint systems include a mercury switch having contacts at the top of a tilted tube that is partially filled with mercury. When a rapid deceleration occurs inertia forces the mercury up into the tube to the contacts and bridges the gap to activate the system. Of course, reorienting the tube will also have the same effect.

The foregoing force activated switches in general depend upon a variety of mechanical elements such as levers, cantilevers, springs, dashpots, or the like, that can jam, become misaligned, leak, or otherwise fail due to their inherent design complexity. The present invention solves the foregoing problems, at least in part, by providing a method and apparatus that employs a composite material that fails at specific applied loads that can be tailored to the application.

The above-mentioned concerns are addressed by the present invention and will be understood by reading and studying the following specification.

SUMMARY

According to a broad aspect of a preferred embodiment of the invention, a switch that is activated by a predetermined mechanical load includes a first layer of plastic material, a second layer of plastic material, a layer of elastomeric material having first and second surfaces, the first surface bonded to the first layer of plastic material by a layer of adhesive material, the second surface of the elastomeric material bonded to the second layer of plastic material by a layer of adhesive and a conductor disposed within one or more of the layers wherein the conductive path is broken when at least one of the adhesive bonds is displaced by the predetermined mechanical load. In one embodiment the conductor is a wire or optical fiber enclosed within the layers. In another embodiment the adhesive material and at least one of the layers is made conductive by the addition of one or more conductive materials. In another aspect of the present invention, the strength of the bonds may be determined by one or more of the following: preparation of the bonding surfaces, curing of the adhesive material or selection of the adhesive.

BRIEF DESCRIPTION OF THE DRAWINGS

The foregoing and other objects, aspects and advantages are better understood from the following detailed description of preferred embodiments of the invention, with reference to the drawings, in which.

DETAILED DESCRIPTION

In the following detailed description of the preferred embodiments, reference is made to the accompanying drawings that form a part hereof, and in which are shown by way of illustration specific embodiments in which the invention may be practiced. It is to be understood that other embodiments may be utilized and structural and/or design changes may be made without departing from the scope of the present invention.

Figure 1A:
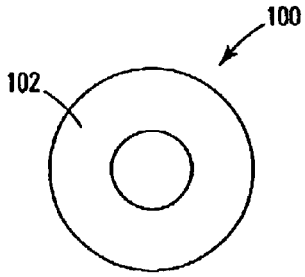
FIG. 1A shows a top view of a material that may be used as substrate or base material for devices made according to one embodiment of the present invention.
Figure 1B:
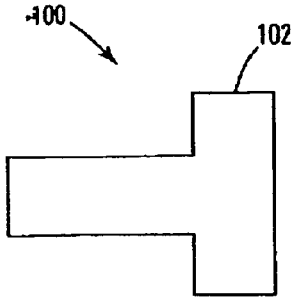
FIG. 1B shows a side view of a material that may be used as substrate or base material for devices made according to one embodiment of the present invention.

FIGS. 1A and 1B show plastic material component 100 (such as a polycarbonate or other thermoplastic or thermosetting material) which may be used as a substrate or base material for devices made according to the present invention. Component 100, in one example, is a right circular cylinder having a flat round head 102 and a cylindrical shaft 104 extending in an axial direction away from head 102 for attachment of the device to another object. Shaft 104 may also be threaded so that it can be easily attached. In another example, component 100 may simply be a layer of material that is attached by other means of attachment such as an adhesive, a clip or screws.

In one example, component 100 is made of Lexan®, a widely used polycarbonate material known for high impact strength, flame retardancy and thermoformability and ideally suited to military and security applications. As will be appreciated by those of skill in the art, a variety of plastic materials (including thermoplastic or thermosetting resin materials), such as epoxies, acrylics or methacrylate, may also be used in connection with the present invention. Additional plastic materials that could be used as substrates in the present invention include but are not limited to:

| | |
|---|---|
| ABS | Acrylonitrile butadiene styrene copolymers |
| CAB | Cellulose acetate butyrate |
| CN | Cellulose nitrate |
| EC | Ethyl cellulose |
| EP | Epoxy resin |
| MF | Melamine formaldehyde |
| PA | Polyamide |
| PC | Polycarbonate |
| PE | Polyethylene |
| PBTP | Polybutylene terephthalate |
| PETP | Polybutylene terephthalate |
| PF | Phenol formaldehyde |
| PMMA | Polymethyl-methacrylate |
| POM | Polyoxymethylene |
| PP | Polypropylene |
| PPO | Polyphenylene oxide |
| PU | Polyurethane |
| PVC | Polyvinyl chloride |
| SAN | Styrene-acrylonitrile copolymer |
| SB | Styrene-butadiene copolymer |
| TPU | Thermoplastic polyurethane |
| UP | Unsaturated polyester |

Figure 2:
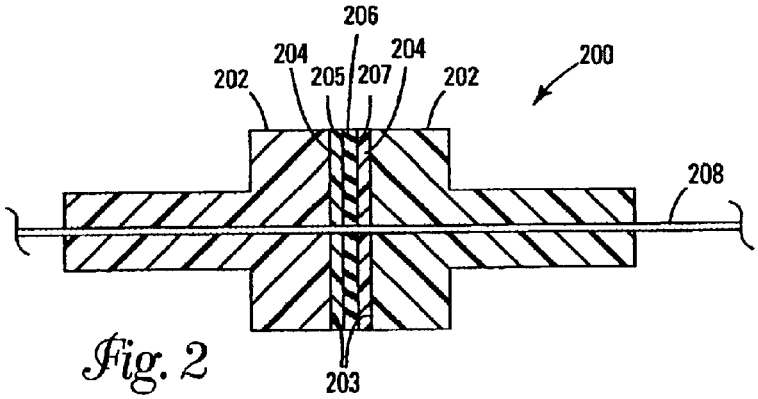
FIG. 2 is an illustration of one embodiment of a force activated switch according to the teachings of the present invention.

Materials that could be used as adhesive in the invention include:

Epoxy warm-cured adhesive
Epoxy cold-curing
Methacrylate cold-curing
Polyurethane cold-curing
Polyester cold-curing
Cyanoacrylate quick-setting
Polyacryldiester anaerobic setting
Neoprene rubber contact adhesive A wide range of elastomeric materials that could be used in the invention include:

Styrene Butadiene Rubber (SBR)
Butadiene Rubber (BR)
Chloroprene Rubber (CR)
(Acrylo) Nitrile Butadiene Rubber (NBR)
Iso Butylene Isoprene (Butyl) Rubber (IIR)
Ethylene Propylene Rubber (EPDM or EPR)
Silicon Rubber
Chloroprene Rubber FIG. 2 shows one embodiment of a force activated switch 200 according to the present invention. Force activated switch 200 is composed of two layers of plastic material 202 (such as a polycarbonate), and an elastomeric layer 206 (such as a butyl rubber) sandwiched between the plastic material layers 202 and bonded to them by an adhesive material 204. An electrical or optical conductor 208, such as a strand of wire or optical fiber, is disposed along a central axis of switch 200. In this example, conductor 208 is positioned within and shielded by switch 200. The switch 200 is activated by a mechanical force that shears or separates the layers of materials 202, 204 and 206, and thus breaks the electrical or optical connection through conductor 208.

Figure 3:
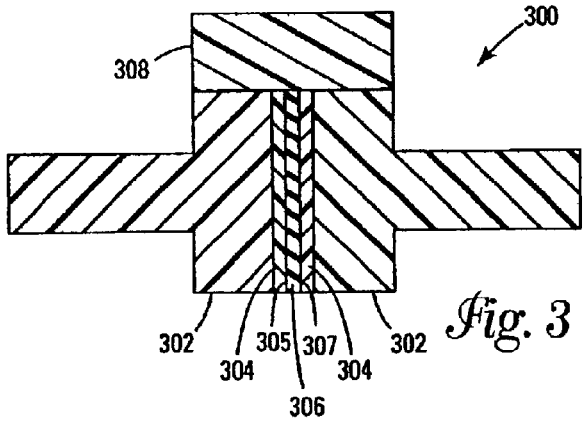
FIG. 3 is an illustration of one additional embodiment of a force activated switch according to the teachings of the present invention.

FIG. 3 shows another embodiment of the present invention. Switch 300 includes two layers of plastic material 302 (such as a polycarbonate), and an elastomeric layer 306 (such as a butyl rubber) sandwiched between plastic layers 302 and bonded to them by an adhesive material 304. In this embodiment, conductor 308 is attached to the outside of switch 300. Conductor 308 may be a conductive tape or foil, or a conductive paint or a wire or fiber. Switch 300 is likewise activated by a mechanical force that shears or separates the layers of materials 302, 304 and 306, and thus breaks the electrical or optical connection through conductor 308.

Figure 4:
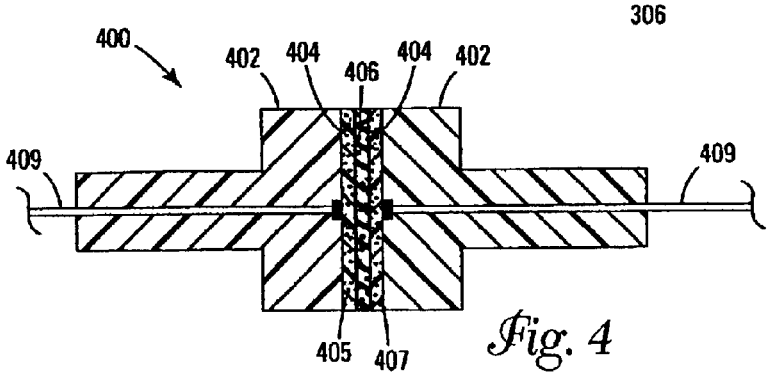
FIG. 4 is an illustration of another additional embodiment of a force activated switch according to the teachings of the present invention.

FIG. 4 shows yet another embodiment of the present invention. Switch 400 includes two layers of plastic material 402 (such as a polycarbonate), and an elastomeric layer 406 (such as a butyl rubber) sandwiched between plastic material layers 402 and bonded to them by an adhesive material 404. In this embodiment, carbon particles 405 have been added to the adhesive material 404 to make the adhesive into an electrically conductive material. Metal powder 407 has likewise been added to the elastomeric layer 406 to make it electrically conductive as well. Thus, electrical current will flow through adhesive 404 and elastomeric layer 406. Contacts or wires 409 may be attached to or inserted in the adhesive 404 for connection to an electrical circuit. Contacts 409 may be inserted through the plastic material 402 or may be placed in the adhesive material 404 prior to curing. Switch 400 is likewise activated by a mechanical force that shears or separates the layers of materials 402, 404 and 406, and thus breaks the electrical or optical connection through adhesive 404 and elastomeric layer 406.

In general, the present invention provides a simple composite switch system that can be tailored to activate at specific applied loads by making simple changes in the manufacturing process. Advantageously, adjustment of the load at which the composite fails requires only changing the curing temperature and/or mechanical surface roughness of the surfaces to be bonded.

The process of making the force activated switch will now be explained with reference to the embodiment shown in FIG. 2. The process steps are essentially the same for other embodiments of the invention. In order to prepare the surfaces 203 for bonding, the surfaces 203 of component 200 may be abraded, for example, with 80 or 100 grit aluminum oxide sand paper. Abrading the surfaces may or may not be desired depending on the force at which the switch is to be activated. Abrading the surfaces to be bonded will tend to strengthen the bond and, in general, will increase the force necessary to activate the switch.

Next, the surfaces 203 are cleaned with a suitable cleaning solution such as isopropyl alcohol solution (e.g., 99% by volume) to remove any residual polycarbonate dust or grit left on the surface from the sand paper. Then, the surfaces 203 are coated with an adhesion promotion solution such as LORD 7701 (a mixture of ethyl acetate and alcohols), followed by drying for several minutes. Surface treatment with isopropyl alcohol and ethyl acetate has important effects on the observed strength of the composite. Isopropyl alcohol moieties tend to interfere with the reaction between polyols (branched chained alcohols) and polyisocyanates in polyurethane adhesives. The ethyl acetate and isopropyl alcohol application process used in fabrication of the present invention provides increased regularity and predictability to the strength of the rubber-polycarbonate bonds.

Both faces 205 and 207 of elastomeric layer 206 may also be sanded with 80 or 100 grit sand paper, for example, followed by cleaning with an isopropyl alcohol solution, application of the LORD 7701 adhesion promoter, and drying. Selection of the grit of sand paper is one factor that will determine rupture strength of the force activated switch. The following table shows the difference in strength between different surface roughness treatments:

| Adhesive | Surface Treatment | Cure Temp | Load at Failure |
|---|---|---|---|
| 7540 | 100 | 63° C. | 239 +/− 41 Lbs |
| 7540 | 80 | 23° C. | 177 +/− 36 lbs |

-continued

| Adhesive | Surface Treatment | Cure Temp | Load at Failure |
|---|---|---|---|
| 7500 | 100 | 63° C. | 261 +/− 31 lbs |
| 7500 | 80 | 23° C. | 149 +/− 15 Lbs |

While a variety of adhesive materials 204 may be used in connection with the present invention, in some examples, a two part polyurethane adhesive, such as Lord 7540, has been used. In the examples the ratio of components is approximately 1 to 1. In other examples, Lord 7500 adhesive has been used. Lord 7500 is a two part adhesive consisting of a black, viscous polyol which is mixed with a cream colored isocyanate mixture in the proportion of 1 part by weight polyol to 1.7 parts isocyanate. As the results discussed below demonstrate, the kind of adhesive material used is another factor that will determine rupture strength of the force activated switch.

The adhesive material 204 is applied to the force activated switch in a standard way. In this example, a small amount of adhesive 204, approximately 0.1 cubic centimeter, is applied to each surface 203 of the polycarbonate components 202 and then spread evenly between surfaces 203.

Once both surfaces 203 have been covered with adhesive 204, elastomeric layer 206 is inserted between polycarbonate components 202, and the components of switch 200 are pressed together. Any excess adhesive 204 is removed and the joined components may be placed in a holder or jig to keep the parts from slipping out of alignment during curing.

Figure 5:
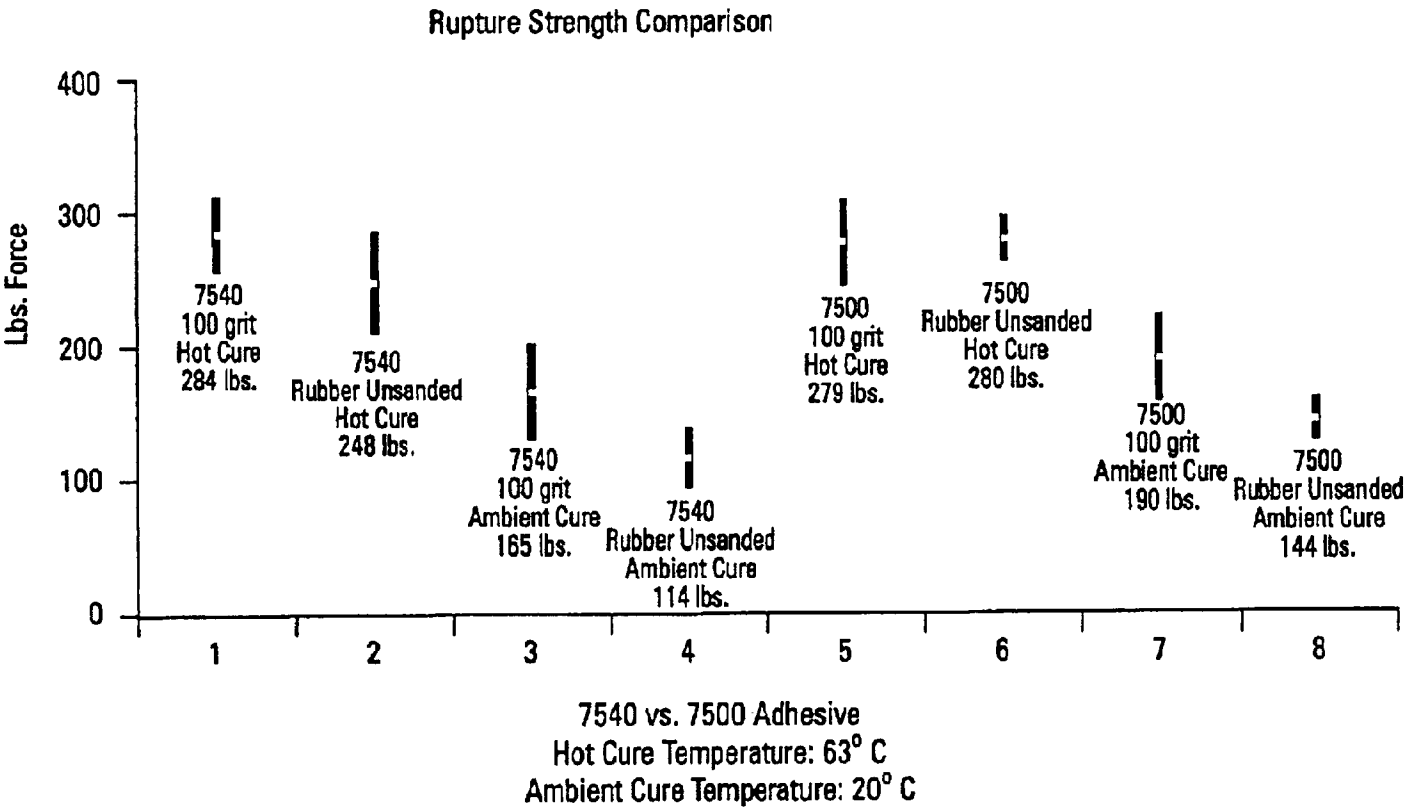
FIG. 5 shows a graph comparing the rupture strength of assemblies prepared according to the present invention with different combinations of adhesive, surface preparation and adhesive curing according to the teachings of the present invention.

FIG. 5 shows a graph comparing the rupture strength of assemblies prepared according to the present invention with different combinations of adhesive, surface preparation and adhesive curing. Eight columns are shown. Each column represents the range of rupture strengths from testing of 10 identically prepared assemblies and the average rupture strength. Forty assemblies were prepared with the Lord 7540 adhesive and forty assemblies were prepared with the Lord 7500 adhesive. Twenty of the assemblies from each adhesive group were hot cured in a 63 degrees Celsius convection oven for 24 hours and twenty were cold cured for a minimum of 48 hours at room temperature. Bonding surfaces of ten of the hot cured assemblies from each adhesive group and curing group were prepared with 100 grit sandpaper. The remaining 10 hot cured assemblies from each adhesive group and curing group were not sanded.

As FIG. 5 demonstrates, the highest rupture strength is obtained by using the Lord 7540 adhesive, sanding the surfaces and hot curing. The lowest rupture strength is obtained by using the Lord 7540 adhesive without sanding the surfaces and cold curing. While there was some variation in the results between samples in the same column all samples failed at loads that were reasonably close to the average. It is anticipated that the variation could be reduced by greater control over process variables.

The following examples illustrate typical applications and embodiments of the present invention and their operation. A force activated switch may be placed in the nosecone of a projectile or in the bumper of an automobile. When the bumper or nosecone collides with an object the forces imparted to the composite cause it to shear or separate. The sheared composite causes the embedded wire or optical fiber to break. The interrupted signal or opening of the electrical circuit causes an explosive squib to fire that actuates an airbag in the passenger compartment of an automobile or in the case of the missile causes the payload to be expelled. Similarly, a device according to one embodiment of the present invention may rest behind reactive armor on a vehicle. When a blow of sufficient force strikes the armor it transfers the force (impulse) to the composite, which would shear. The shearing of the composite would cause the wire or optical fiber to break and send a signal to fire the explosive elements behind the armor. The devices thus act as a switch, which only actuates on receiving a force, impulse or load sufficient to make the composite shear at the interface between the polycarbonate and the rubber. The composite is configured so that forces of insufficient magnitude (such as minor collisions of a bumper) do not shear the composite at the rubber polycarbonate interface and preclude the firing of the airbag. Similarly in the missile device, the forces imparted during launch are insufficient to shear the composite and prevent premature ejection of the payload. Additionally in the case of reactive armor minor collisions with trees, buildings, or small arms fire are not sufficient to shear the composite and prevent premature or unnecessary firing of the reactive armor explosive element. The devices thus add an additional safety mechanism to prevent firing of explosive squibs that actuate airbags, missile payloads, or reactive armors. In yet another embodiment the device could be coupled to the shaft of pass cutting blade of a lawn mower. If the blade impacted a large rock or other immovable object the composite would fail, mechanically decoupling the blade from the power source of the mower and simultaneously sending an electrical signal to stop the engine.

The present invention is an improvement over existing systems or processes because it can be configured to shear over a range of applied mechanical loads without changing the three basic components of its construction (such as the plastic polycarbonate, the adhesive polyurethane, and the butyl rubber used in the test examples). Thus, the present invention allows modification of the strength of the joint simply by varying curing temperature and time and surface treatment of the components.

The present invention also has the advantage of being a very small electromechanical element, which is not dependent on springs, gears, dashpots, clockwork or other complicated mechanisms that can jam, become misaligned, leak or fail due to their inherent design complexity. The present invention also obviates the need for complicated and expensive pressure transducers coupled with complex electronic circuits that must interpret the signal form a pressure transducer in the presence of electrical and acoustic noise that can lead to unintentional firing. The present invention eliminates such complex electronic circuitry and replaces the circuit with a strand of conducting wire or optical fiber that is either transmitting current/signal or not. For the non-transmitting mode or state to exist, the composite must be sheared, which can only occur if a force of sufficient strength has been transmitted to the interface between polycarbonate and rubber. Minor forces or stray electrical signals are ignored by the present invention, leading to increased safety and reliability.

The option of using an optical fiber as a signal conductor provides the opportunity to transmit a multitude of complex signals and instructions to fire control systems and computers and may, in many applications, provide even greater safety and prevent unanticipated firing of explosive elements within missile, rocket, ammunition, or automobile passenger safety airbag systems due to electrical interference.

CONCLUSION

In conclusion, the present invention provides a combination of an electrical or optical transmission circuit coupled to a mechanical composite structure designed to fail under loads that can be tailored and varied by simple modification of a manufacturing process. The invention may be used as part of a safe and arm mechanism for a multitude of armament devices including rockets, mortars, projectiles, and missiles. The device may also be situated in vehicle bumpers to provide a signal for the actuation of a passive restraint safety system such as an airbag. The application of ethyl acetate and isopropyl alcohol to the composite structure provides increased reliability of the rubber-polycarbonate bonds, and allows the mechanical strength of the bonds to be varied over a predictable range. Although specific embodiments have been illustrated and described herein, it will be appreciated by those of ordinary skill in the art that any arrangement which is calculated to achieve the same purpose may be substituted for the specific embodiments shown. This application is intended to cover any adaptations or variations of the present invention. Therefore, it is intended that this invention be limited only by the claims and the equivalents thereof.

What is claimed is:

1. A switch that is activated by a predetermined mechanical force, comprising:

a first layer of plastic material;

a second layer of plastic material;

a layer of elastomeric material having first and second surfaces, said first surface of said elastomeric material bonded to said first layer of plastic material by a layer of adhesive material, and said second surface of said elastomeric material bonded to said second layer of plastic material by a layer of adhesive material; and a conductor disposed in contact with one or more of said layers, wherein a conductive path of said conductor is broken when at least one of said adhesive bonds is displaced by said predetermined mechanical force.

2. The switch of claim 1, wherein said conductor comprises an electrical conductor.

3. The switch of claim 1, wherein said conductor comprises an optical transmission media.

4. The switch of claim 1, wherein said elastomeric material comprises a butyl rubber.

5. The switch of claim 1, wherein said plastic material comprises a polycarbonate.

6. The switch of claim 1, wherein said adhesive material comprises a polyurethane.

7. The switch of claim 1, wherein said conductor is disposed on the outside of said layers.

8. The switch of claim 1, wherein said conductor comprises a conductive material that is integrated with one or more of said layers.

9. The switch of claim 8, wherein said conductor comprises a metal powder mixed with said elastomeric material.

10. The switch of claim 9, wherein said conductor comprises a graphite material mixed with at least one of said layers of adhesive material.

11. A switch that is activated by a predetermined force, comprising a multilayered composite of:

a first layer of polycarbonate material;

a second layer of polycarbonate material;

a layer of butyl rubber having first and second surfaces, said fist surface bonded to said first layer of polycarbonate material by a layer of polyurethane adhesive having a predetermined rupture strength, and said second surface of said butyl rubber bonded to said second layer of polycarbonate material by a layer of polyurethane adhesive having a predetermined rupture strength; and a conductor disposed in contact with one or more layers of said multilayer composite wherein a conductive path of said conductor is broken when at least one of said layers is displaced by the predetermined force.

12. The switch of claim 11, wherein one or more of said surfaces bonded by said adhesive is abraded.

13. The switch of claim 11, wherein said adhesive is hot cured.

14. The switch of claim 11, wherein said adhesive is cured at room temperature.

15. A method of manufacturing a force activated switch, comprising;

adhering a first layer of polycarbonate material to a first surface of a layer of butyl rubber using a polyurethane adhesive;

adhering a second layer of polycarbonate material to a second surface of said layer of butyl rubber using a polyurethane adhesive; and disposing a conductor in contact with one or more of said layers wherein a conductive path of said conductor is broken when at least one of said adhesive bonds is displaced by a predetermined mechanical load.

16. The method of claim 15, wherein disposing a conductor in contact with one or more of said layers comprises mixing a conductive material with one or more of said layers.

17. The method of claim 15, wherein at least one surface bonded by said adhesive is prepared by abrasion.

18. The method of claim 15, wherein at least one surface bonded by said adhesive is prepared by application of at least one of ethyl acetate and isopropyl alcohol.

19. The method of claim 15, further comprising hot curing said adhesive.

20. The method of claim 15, further comprising curing said adhesive at room temperature.

21. A force activated switch, comprising:

a first layer of plastic material;

a second layer of plastic material;

a layer of elastomeric material having first and second surfaces, said first surface bonded to said first layer of plastic material by a layer of adhesive and said second surface bonded to said second layer of plastic material by a layer of adhesive; and a conductor disposed in contact with one or more of said layers to form a conductive path and wherein said conductive path is broken when at least one of said adhesive bonds is displaced by a predetermined mechanical load; and wherein said predetermined mechanical load required to displace at least one of said adhesive bonds is calibrated by one or more of the following:

preparation of one or more of said surfaces of said layers;

selection of adhesive; and curing of said adhesive.

22. The switch of claim 21, wherein said preparation of one or more of said surfaces of said layers comprises abrasion.

23. The switch of claim 21, wherein said preparation of one or more of said surfaces of said layers comprises application of at least one of ethyl acetate and isopropyl alcohol.

24. The switch of claim 21, wherein said adhesive comprises a polyurethane.

25. The switch of claim 21, wherein said elastomeric material comprises a butyl rubber.

26. A switch that is activated by a predetermined mechanical load, comprising:

a first layer of polycarbonate material;

a second layer of polycarbonate material;

a layer of elastomeric material having first and second surfaces, said first surface bonded to said first layer of polycarbonate material by a layer of adhesive material and said second surface of said elastomeric material bonded to said second layer of polycarbonate material by a layer of adhesive; and a conductor disposed in contact with one or more of said layers to form a conductive path and wherein said conductive path is broken when at least one of said adhesive bonds is displaced by said predetermined mechanical load.

27. An electrical switch manufactured by a process comprising:

adhering a first layer of polycarbonate material to a first surface of a layer of butyl rubber by a polyurethane adhesive;

adhering a second layer of polycarbonate material to a second surface of said layer of butyl rubber by a polyurethane adhesive; and disposing a conductor in contact with one or more of said layers wherein a conductive path of the conductor is broken when at least one of the adhesive bonds is displaced by a predetermined mechanical load.

28. The electrical switch of claim 27, wherein said predetermined mechanical load required to displace at least one of said adhesive bonds is calibrated by one or more of the following:

preparation of one or more of said surfaces of said layers;

selection of adhesive; and curing of said adhesive.

* * * * *